US010851628B1

(12) United States Patent
Anderson et al.

(10) Patent No.: US 10,851,628 B1
(45) Date of Patent: Dec. 1, 2020

(54) GAS LIFT SYSTEM

(71) Applicant: INNOVEX DOWNHOLE SOLUTIONS, INC., Houston, TX (US)

(72) Inventors: Adam Anderson, Houston, TX (US); Carlos Isaac Venegas, Jr., Houston, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 0 days.

(21) Appl. No.: 16/884,763

(22) Filed: May 27, 2020

Related U.S. Application Data

(60) Provisional application No. 62/950,526, filed on Dec. 19, 2019.

(51) Int. Cl.
*E21B 43/12* (2006.01)
*E21B 34/16* (2006.01)
*E21B 34/10* (2006.01)

(52) U.S. Cl.
CPC ..... *E21B 43/123* (2013.01); *E21B 34/10* (2013.01); *E21B 34/16* (2013.01)

(58) Field of Classification Search
CPC ..... E21B 43/123; E21B 34/12; E21B 34/16; E21B 43/1235; E21B 43/13
See application file for complete search history.

(56) References Cited

U.S. PATENT DOCUMENTS 4,295,795 A * 10/1981 Gass ..... E21B 34/066 137/155
2015/0107848 A1* 4/2015 Leitch ..... F04B 47/00 166/373
2019/0145220 A1* 5/2019 Patel ..... E21B 34/10 166/375

* cited by examiner

*Primary Examiner* — Kristyn A Hall
(74) *Attorney, Agent, or Firm* — MH2 Technology Law Group LLP

(57) ABSTRACT

A gas-lift system includes a first valve configured to provide selective communication of a wellbore fluid between an interior of a production tubing an annulus defined exterior to the production tubing, a second valve configured to provide selective communication of the wellbore fluid between the interior of the production tubing and the annulus, and one or more control lines coupled to the first valve and the second valve. The one or more control lines apply a pressure differential to the first and second valves. The first valve is configured to actuate from an open position to a closed position in response to the pressure differential reaching a first pressure differential, and wherein the second valve is configured to actuate from an open position to a closed position in response to the pressure differential reaching a second pressure differential that is different from the first pressure differential.

18 Claims, 5 Drawing Sheets

GAS LIFT SYSTEM

CROSS-REFERENCE TO RELATED APPLICATIONS

This application claims priority to U.S. Provisional Patent Application having Ser. No. 62/950,526, which was filed on Dec. 19, 2019 and is incorporated herein by reference in its entirety.

BACKGROUND

In oil and gas wells, hydrostatic pressure of fluid in the well may be too high to allow for unassisted production of fluids from within the formation. Gas lift, sometimes referred to as "artificial lift" may thus be employed to alleviate the hydrostatic pressure above the lower area of the well and thereby allow hydrocarbons to be recovered therefrom.

To this end, a production tubing with a gas-lift valve, generally proximal to the bottom of the production tubing, may be deployed into the well. The valve may be open, and fluid may initially fill the annulus between the well and the production tubing, as well as the inside of the production tubing. A gas may then be supplied into the annulus at pressure, which may drive the gas-liquid interface in the annulus downward, below the level of the gas-lift valve. The gas may then flow into the production tubing through the open gas-lift valve and may partially fill the production tubing. This may reduce the hydrostatic pressure at the bottom of the production tubing, thereby allowing the pressure of the fluid in the reservoir to draw the hydrocarbons through the production tubing and to the surface.

In some cases, multiple gas-lift valves may be used at different positions along the length of the production tubing. The function may be similar to the single-valve system discussed above. The gas-lift valves may initially all be open, e.g., as the hydrostatic pressure provided by the column of fluid in the annulus may be above a closing pressure of the gas-lift valves. Gas may be injected into the annulus, pushing the column of fluid downward until the shallowest valve is in communication with the gas. The gas may then proceed through the shallowest valve, as explained above. Gas may, however, continue to be injected, further driving the gas-liquid interface downward in the annulus, until the gas reaches the next-shallowest valve. When this occurs, the gas may begin flowing into the production tubing via the second valve. Further, the gas pressure in the annulus at the shallowest valve may drop below the closing pressure of the first valve, resulting in the first valve shutting. This process may repeat for each subjacent valve.

However, gas-lift valve systems generally use the injection pressure in the annulus to actuate the valves. This can potentially limit the number of valves that can be used while still staying within practical injection pressure constraints.

SUMMARY

Embodiments of the disclosure may provide a gas-lift system including a first valve configured to be coupled to a production tubing. The first valve is configured to provide selective communication of a wellbore fluid between an interior of the production tubing an annulus defined exterior to the production tubing. The system also includes a second valve configured to be coupled to the production tubing at a position that is subjacent to the first valve. The second valve is configured to provide selective communication of the wellbore fluid between the interior of the production tubing and the annulus. The system further includes one or more control lines coupled to the first valve and the second valve. The one or more control lines are configured to apply a pressure differential to the first and second valves, and the first valve is configured to actuate from an open position to a closed position in response to the pressure differential reaching a first pressure differential. The second valve is configured to actuate from an open position to a closed position in response to the pressure differential reaching a second pressure differential that is different from the first pressure differential.

Embodiments of the disclosure may also provide a method for operating a gas-lift system. The method includes injecting a gas into an annulus between a production tubing and a well. The gas flows from the annulus into the production tubing through a first valve that is open. The method also includes closing the first valve by controlling a pressure in a control line that is coupled to the first valve, without causing or permitting a second valve that is subjacent to the first valve to close. The pressure in the control line is independent of a pressure of the gas in the annulus. The method further includes increasing the pressure of the gas in the annulus after closing the first valve, such that the gas flows through the second valve and into the production tubing, and closing the second valve by controlling the pressure in the control line, which is also coupled to the second valve, independently of the pressure of the gas in the annulus, while maintaining the first valve in a closed position.

Embodiments of the disclosure may further provide a gas-lift system including a production tubing extending into a wellbore. An annulus is defined radially between the production tubing and the wellbore. The system also includes a plurality of gas-lift valves disposed at different depths in the wellbore and configured to selectively communicate the annulus with an interior of the production tubing, a surface system comprising a pump configured to pump a hydraulic fluid, and a first control line extending from the surface system to the plurality of gas-lift valves, the first control line being configured to deliver the hydraulic fluid from the pump to the plurality of gas-lift valves to control opening and closing of the gas-lift valves independently of a pressure in the annulus.

BRIEF DESCRIPTION OF THE DRAWINGS

The present disclosure may best be understood by referring to the following description and accompanying drawings that are used to illustrate some embodiments. In the drawings.

DETAILED DESCRIPTION

Figure 1:
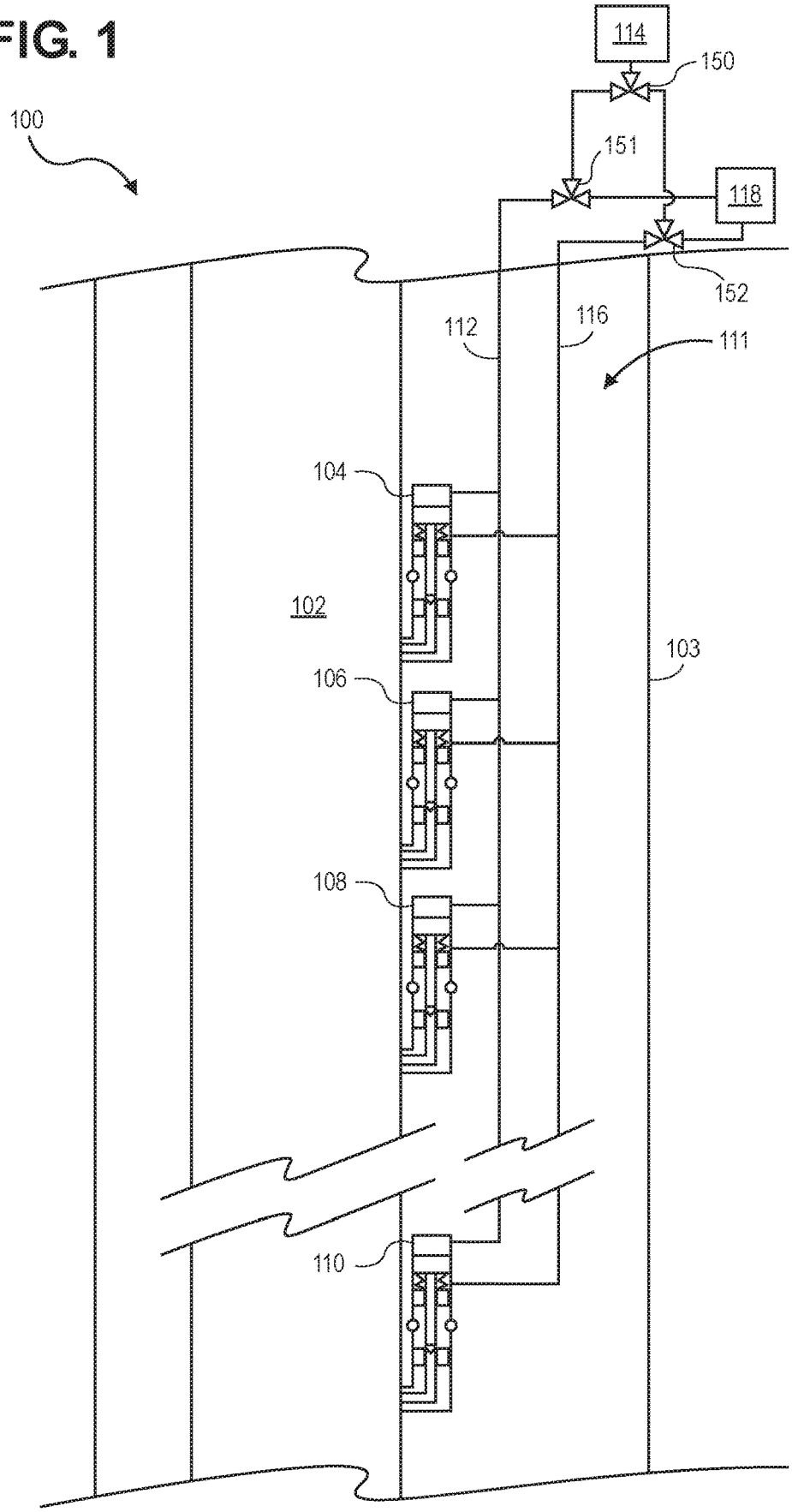
FIG. 1 illustrates a side, schematic view of a gas lift system in a well, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a side, schematic view of a gas-lift system 100, according to an embodiment. The gas-lift system 100 may be configured to reduce a hydrostatic pressure in a production tubing 102 that is deployed into a well 103. Thus, the gas-lift system 100 may be configured to aid in the production of reservoir fluid (e.g., hydrocarbons) from the well 103, at the lower extent of the production tubing 102, through the production tubing 102, and up to the surface above the production tubing 102.

The gas-lift system 100 may include a plurality of valves (by way of example, four are shown: 104, 106, 108, 110, although any number may be employed), which may be positioned in an annulus 111 between the production tubing 102 and the well 103. For example, the valve 104 may be the shallowest valve, the valve 106 may be subjacent to the valve 104, the valve 108 may be subjacent to the valve 106, and the valve 110 may be subjacent to the valve 108. In some embodiments, additional valves may be employed, e.g., between the valve 108 and the valve 110.

First and second control lines 112, 116 may extend from a surface system (e.g., located at the ground-level) to the valves 104, 106, 108, 110 and may be connected thereto in parallel as shown. The surface system may include a pressurized fluid source 114, such as a pump, and a tank 118. The tank 118 may include one or more devices configured to modulate a pressure of the fluid therein, e.g., a piston. In other embodiments, the tank 118 may simply hold the fluid, and such that hydrostatic pressure generated by the height of the control line 112, 116 coupled thereto acts on the valves 104-110. In some embodiments, the surface system may also include one or more valves 150, 151, 152 that are configured to control which control line 112, 116 is connected to the pressurized fluid source 114 and the tank 118. For example, in a first configuration, the pressurized fluid source 114 may be connected via the valves 150, 151 to the first control line 112, while the tank 118 may be connected via the valve 152 to the second control line 116. In a second configuration, the valves 150-152 may be modulated such that the tank 118 may be connected to the first control line 112 via the valve 151, and the pressurized fluid source 114 may be connected to the second control line 116 via the valves 150, 152.

Each of the valves 104, 106, 108, 110 may have a different actuation pressure differential. The actuation pressure differential may be the pressure differential between the first and second control lines 112, 116 at which the valves 104, 106, 108, 110 actuate, either to close or open, as will be described in greater detail below. For example, the valve 104 may be configured to close in the presence of a first pressure differential and remain closed and lower pressure differentials. The valve 106 may be configured to close in the presence of a second pressure differential that is greater than the first pressure differential and remain closed at lower pressure differentials. This pattern of increasing closing pressure differentials may continue for subjacent valves 106, 108, 110.

When the valves 104-110 are open, the valves 104-110 permit wellbore fluid to flow from the annulus 111 into the production tubing 102. Specifically, gas may be injected into the annulus 111, which is otherwise full of liquid (or a combination of liquid and gas, i.e., a fluid). As the gas pressure increases, the interface between the gas and liquid is driven downwards. When the valves 104-110 are closed, the valves 104-110 block fluid flow therethrough and into production tubing 102. When the valves 104-110 are open, they allow gas flow into the production tubing 102, generally at the depth where the top-most open valve 104-110 is positioned.

By using separate control lines 112, 116 to control actuation, rather than pressure in the wellbore fluid that resides in the annulus 111 and is received into the production tubing 102 through any of the valves 104-110 that are open, the gas-lift system 100 may be able apply a greater range of pressures to actuate the valves 104-110. For example, the range of actuation pressures used in the control lines 112, 116 may be above pressures that, if experienced in the wellbore fluid in the annulus 111, would damage the well 103 and/or are beyond the practical capabilities of wellbore pumping equipment that is commonly used for artificial lift. In some applications, gas injection into the annulus 111 may be generally performed at between about 20 psi to about 80 psi, and thus, if injection pressure is used to actuate the valves 104-110, valve actuation pressures are also in this range. However, since a separate hydraulic pressure differential is employed in the present system 100, the valve actuation pressures can be outside of this range, e.g., through pumping, e.g., a generally incompressible, hydraulic fluid that can be raised to much higher pressures, if desired. Further, the hydrostatic pressure acting through one or both of the lines 112, 116 can be employed either to "balance" the pressure in the valve 104-110 or to assist in opening or closing the valve 104-110, as will be described in greater detail below.

Figure 2:
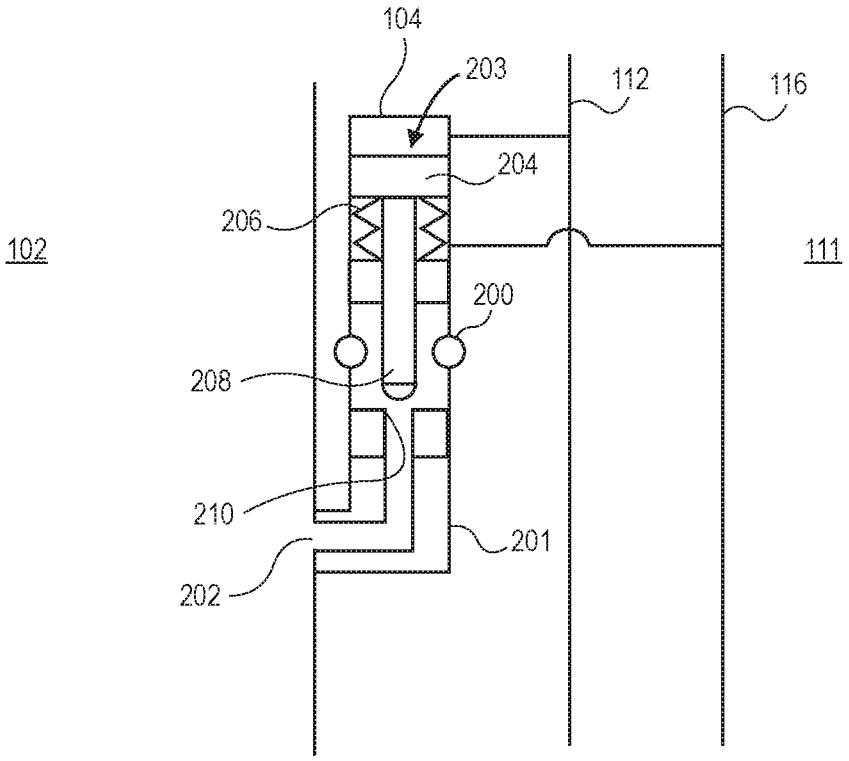
FIG. 2 illustrates a side, schematic view of a valve of the gas lift system in an open position, according to an embodiment.
Figure 3:
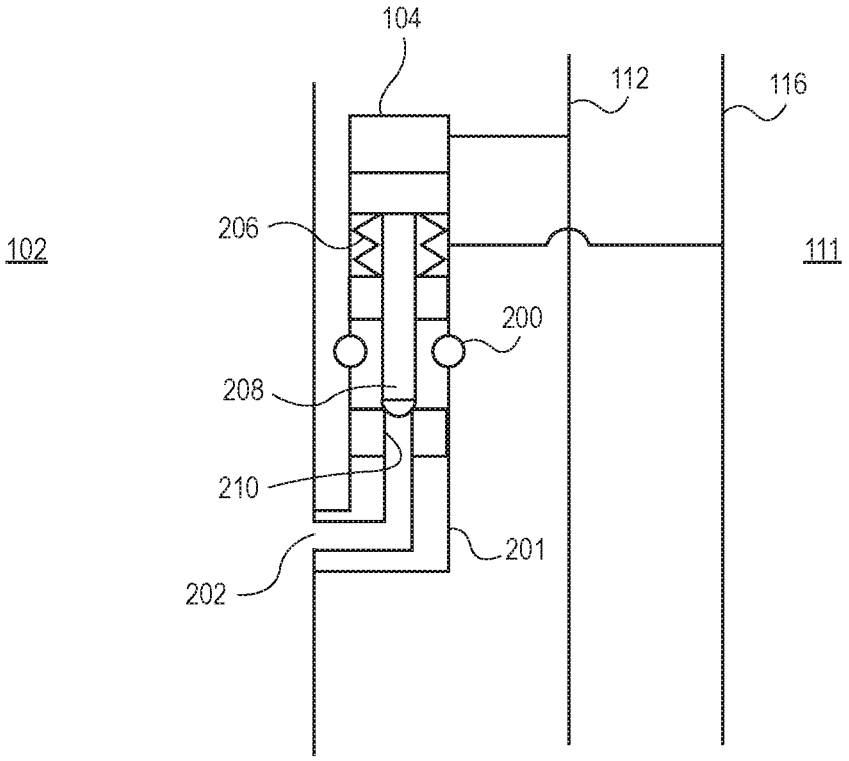
FIG. 3 illustrates a side, schematic view of the valve of the gas lift system, in a closed position, according to an embodiment.

FIG. 2 illustrates an enlarged view of the valve 104 of the gas-lift system 100 in an open position, according to an embodiment. In this embodiment, the open position may be the default position, such that a pressure differential is applied to actuate the valve 104 into a closed position. As such, the actuation pressure differential may be described as a closing pressure differential. However, this is merely an example, and default-closed valves 104 may also be employed, in which the actuation pressure differential is instead an opening pressure differential, as will be described below. Further, FIG. 3 illustrates an enlarged view of the valve 104 in a closed position, according to an embodiment. The illustrated embodiment of the valve 104 may be representative of the other valves 106-110 of the system 100, according to at least some embodiments.

As shown, the valve 104 is coupled to the production tubing 102 and provides a flowpath between the annulus 111 and the interior of the production tubing 102. For example, the valve 104 may define the flowpath between ports 200 in a housing 201 of the valve 104, and an opening 202 formed in the production tubing 102.

In an embodiment, the valve 104 may include a chamber 203 in the housing 201 and a piston 204 positioned in the chamber 203. A biasing member 206, such as a spring, Bellville washer, etc., may also be positioned in the chamber 203 on a first, lower side of the piston 204, and may apply a spring force on the piston 204, in this embodiment, in an upward direction.

The piston 204 may be coupled to a valve element 208 and may move the valve element 208 with respect to a valve seat 210. When the valve element 208 is lifted away from the valve seat 210, the flowpath is opened, and thus the valve 104 is open (FIG. 2). When the valve element 208 engages the valve seat 210, the flowpath between the ports 200 and the opening 202 is blocked by the valve element 208, and the valve 104 is closed (FIG. 3). In the absence of a sufficient pressure differential across the piston 204, the biasing member 206 may force the piston 204 upwards, resulting in the default position of the valve element 208 being lifted above the valve seat 210, meaning the valve 104 is open.

The control lines 112, 116 may be in communication with the chamber 203. In particular, the first control line 112 may communicate with a second side of the piston 204 and the second control line 116 may communicate with the first side of the piston 204. Accordingly, when the pressure in the first control line 112 differs from the pressure in the second control line 116, a pressure differential across the piston 204 results. In an embodiment, the pressure in the first control line 112 may be higher than the pressure in the second control line 116, e.g., by the first control line 112 communicating with the pressurized fluid source 114 (FIG. 1), while the second control line 116 communicates with the tank 118 (FIG. 1). This pressure differential may thus tend to move the piston 204. It will be appreciated that, if the second control line 116 is omitted, the pressure differential may be between a preset (e.g., ambient) pressure in the chamber 203 below the piston 204 and the pressure in the first control line 112.

The biasing member 206 may at least partially set the minimum force required to close the valve 104. For example, the biasing member 206 may have a spring constant and may apply a spring force that varies with compression distance. Accordingly, to close the valve 104, the pressure differential may need to apply a force at or above the spring force at a compression distance (stroke) sufficient to cause the valve element 208 to engage the valve seat 210. Thus, given a set surface area for the piston 204, the pressure differential across the piston 204 needed to generate the closing force, i.e., the closing pressure differential, may be set based at least partially by selection of the biasing member 206.

Referring additionally to FIG. 1, the actuation pressure differential may vary as between the valves 104-110, e.g., by selecting different biasing members 206 for the valves 104-110, different geometries, etc. Accordingly, the opening and closing of the valves 104-110 may be controlled by the pressure differential in the control lines 112, 116, e.g., by raising and lowering the pressure supplied by the pressurized fluid source 114 into the first control line 112 and/or controlling pressure in the second control line 116. For example, at a first pressure differential that is at or above the actuation pressure differential for the valve 104, the valve 104 may be closed. However, this first pressure differential may be insufficient to close the other valves 106-110, which may thus remain open.

A second pressure differential may be supplied by the first and/or second control lines 112, 116 that is different from, e.g., above, the first pressure differential. The second pressure differential may also be above the closing pressure differential for the valve 106, and thus the valve 106 may be closed (in addition to the valve 104, which may remain closed). This pattern may repeat for the remaining valves 108, 110 which may have increasing closing pressure differentials, which may be reached by increasing the pressure differential between the first and second control lines 112, 116. As such, the valves 106-110 may be sequentially closed by increasing the pressure differential between the control lines 112, 116.

Figure 4:
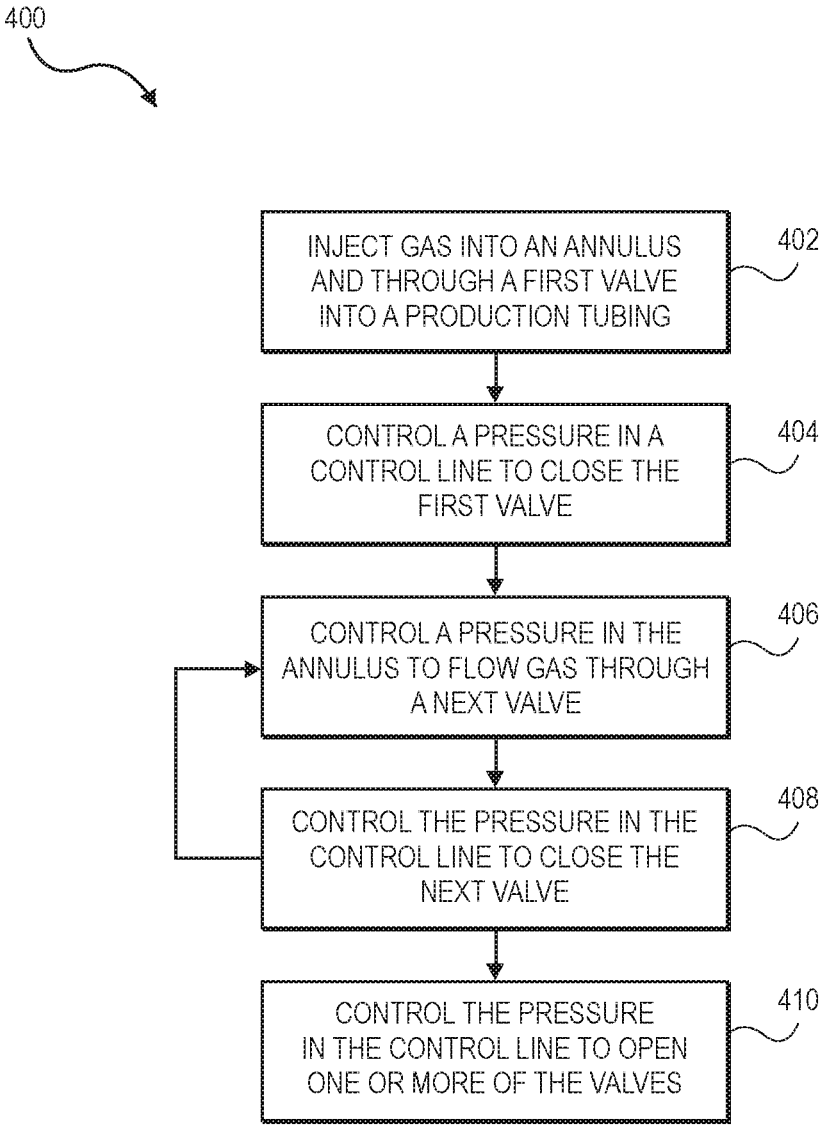
FIG. 4 illustrates a flowchart of a method for operating a gas lift system, according to an embodiment.

FIG. 4 illustrates a flowchart of a method 400 for operating a gas-lift system (e.g., the gas-lift system 100), according to an embodiment. The method 400 may include injecting gas into an annulus 113 between a production tubing 102 and a well 103 and into an interior of the production tubing 102 via a first valve 104, as at 402.

Before, during, or after injecting the gas into the annulus 111, the method 400 may also include controlling a pressure in a first control line 112 such that a first pressure differential is applied to valves 104-110, including the first valve 104, of the system 100, as at 404. The first control line 112 may extend into an annulus 111 between a well 103 and the production tubing 102, to the valves 104-110. In an embodiment, the first control line 112 may be connected to the valves 104-110 in parallel, such that the first control line 112 communicates the pressure therein with each of the valves 104-110 generally at the same time. As described above, a second control line 116 may also be provided, and connected to the valves 104-110 in parallel, but in some embodiments, may be omitted.

Further, the control lines 112, 116 and the valves 104-110 may be configured to keep the fluid in the first control lines 112, 116 separate from the fluid in the annulus 111. As such, the pressure in the control lines 112, 116 may be controlled independently of the pressure in the annulus 111. In some embodiments, the pressure of the gas in the annulus 111 may increase while the pressure in the control line 112 and/or 116 is increased or decreased, e.g., increasing or decreasing pressure in the control lines 112 and/or 116 at 404 may not cause a change in the pressure in the annulus 111 and vice versa.

In some embodiments, the control valves 104-110 may default to the closed position, such that a certain pressure differential between the first and second control lines 112, 116 is required to open the valves 104-110 (or, if only the first control line 112 is provided, a certain pressure in the first control line 112 is required). In other embodiments, the control valves 104-110 may default to the open position, such that pressure in the first control line 112 is required to close the valves 104-110. In either example, the control valves 104-110 may either be deployed in an open state, or actuated into the open state, e.g., before commencing artificial lift operations.

The valves 104-110 may be configured to actuate (change state between closed and open) at different pressures. In a default-closed embodiment, the pressure differential needed to keep the valves 104-110 open may be sequentially lower as proceeding downward from valve to valve. In a default-open embodiment, the pressure differential needed to close the valves 104-110 may be sequentially higher as proceeding upward from valve to valve. Accordingly, the pressure in the first control line 112 may cause the pressure differential in the first valve 104 to be raised or lowered, according to the respective embodiment to control the opening and closing of the valves 104-110, and thereby sequentially close the valves 104-110 to support the gas-lift operations.

Since the first control line 112 and/or the second control line 116 are coupled to the valves 104-110 in parallel, each of the valves 104-110 may experience generally a consistent, first pressure differential generated at least in part by the pressure applied via the first control line 112. The first pressure differential may cause or permit the first valve 104 to be in a closed position, thereby blocking gas flow from the annulus 111 into the production tubing 102 via the first valve 104. The first pressure differential may, however, not close the next valve (e.g., the valve 106), or any subjacent valves (e.g., the valves 108, 110), which may remain open.

The method 400 may also include controlling, e.g., increasing, a pressure of the gas in the annulus 111, such that the gas-liquid interface is pushed downward in the annulus 111, until the gas begins flowing through the next valve 106, as at 406. Since the valve 104 is closed, gas is prevented from flowing therethrough, which allows the gas-liquid interface to be moved downward, past the valve 104. The pressure in the first and/or second control lines 112, 116 may maintain the pressure differential in the valves 104-110, such that the closed valves (in this case, valve 104) remain closed.

The method 400 may then include controlling a pressure of the fluid in the first control line 112 and/or the second control line 116, such that the closed, superposed valves (e.g., first valve 104) remain closed, as well as closing the next valve (e.g., valve 106). Thus, the previously-closed valve(s) 104 may remain closed, the next valve 106 may also be closed. As such, the pressure of the gas in the annulus 111 may again be increased, thereby forcing the gas-liquid interface downward, past the valve 106, so as to allow gas to flow through the next subjacent valve (e.g., the valve 108).

As indicated, this sequence of controlling the pressure in the control lines 112, 116 and increasing pressure in the annulus 111 may be repeated to sequentially close the valves 104-110 and control where the gas is injected into the production tubing 102 from the annulus 111. Any number of valves 104-110 may be employed in this manner.

At some point, it may be desirable to open the valves 104-110. To do so, the method 400 may include again controlling the pressure in the first control line 112, as at 408. This may include lowering the pressure for default-open valves 104-110 or increasing the pressure for default-closed valves 104-110. Such pressure control in the first control line 112 and/or second control line 116 may be independent of the pressure in the annulus 111. For example, the pressure differential between the first control line 112 and the second control line 116 may be raised or lowered to a pressure sufficient to open the desired valves 104-110, while keeping other valves 104-110 closed. Further, in at least some embodiments, the second control line 116 may be coupled to the pump 118, e.g., by modulating the valves 150-152 of the surface system, so as to reverse the pressure differential to assist in opening the valves 104-110 as needed.

The valves 104-110 may thus provide for selective communication of wellbore fluid between the annulus 111 and the interior of the production tubing 102. Although the system 100 and method 400 are described herein in terms of sequentially closing the valves 104-110 in order of shallowest to deepest, it will be appreciated that any order of opening/closing may be provided by appropriate selection of the closing pressure differential for the valves 104-110 relative to one another.

Figure 5:
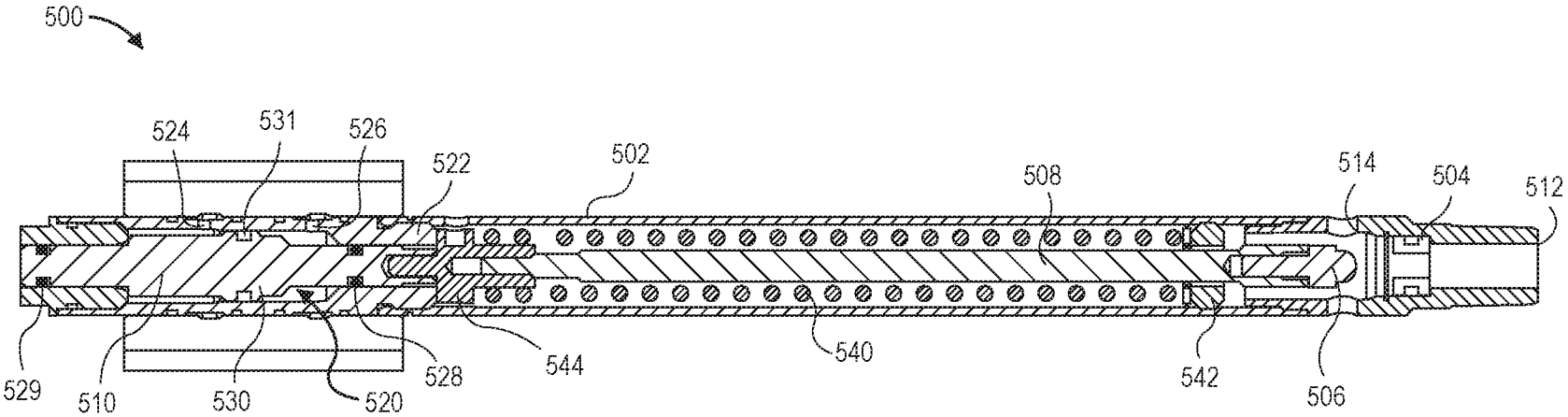
FIG. 5 illustrates a side, cross-sectional view of the valve of the gas lift system, according to an embodiment.

FIG. 5 illustrates a partial, side, cross-sectional view of a valve 500, according to an embodiment. The valve 500 may be an example of one or more of the valves 104-110 used in the gas-lift system 100 and method 400 discussed above. In particular, the valve 500 may have a default open position, such that a pressure differential between the first control line 112 and the second control line 116 is used to close the valve 500.

For example, the valve 500 may include a housing 502, a seat 504, a valve closure element 506, an elongate rod 508, and a piston 510. The housing 502 may be a unitary structures, as shown, or may be made from two or more bodies that are connected (e.g., threaded) together. The housing 502 may define an open axial end or "opening" 512, which may be in communication with the interior of the production tubing 102 (e.g., providing the opening 202 of FIG. 2). The housing 502 may also be open to the annulus 111 on its opposite axial end 513. A primary port 514 may be defined through the housing 502, which may communicate the surrounding environment within the annulus 111 with the interior of the housing 502.

The seat 504 may be interposed between the port 514 and the open axial end 512. For example, the seat 504 may be defined by or connected to the housing 502. Further, the valve closure element (e.g., a partially spherical member) 506 may be engageable with the seat 504, to selectively permit or block communication of fluid from the port 514 to the open axial end 512.

The valve closure element 506 may be coupled to the rod 508, which may be in turn coupled to the piston 510. In some embodiments, these structures 506-510 may be formed as a single piece, but in other embodiments, may be made separately and connected together. Accordingly, the valve closure element 506 may be moved by movement of the piston 510, with such movement being transmitted therebetween by the rod 508. The piston 510 may be positioned within a chamber 520 defined in the housing 502. For example, a first control port 524 and a second control port 526 may be defined through the sub 522. The first control port 524 may be in fluid communication with the first control line 112, and the second control port 526 may be in fluid communication with the second control line 116. Accordingly, fluidic pressure within the control lines 112, 116 may be communicated into the chamber 520 via the first and second control ports 524, 526, respectively. The chamber 520 may be sealed from the rest of the interior of the housing 502 via one or more seals 528, 529 between the piston 510 and the housing 502, such that fluid in the control lines 112, 116 is maintained separate from the fluid in the annulus 111 that is received into the housing 502 via the ports 514.

The piston 510 may include a radially-enlarged section 530, which may include a seal 531 for sealing with an inner surface of the chamber 520, while allowing movement of the piston 510 relative to the housing 502, e.g., responsive to pressure differentials. The radially-enlarged section 530 may be proximal to a middle of the piston 510, such that the piston 510 separates the chamber 520 between the first and second control ports 524, 526. Accordingly, a higher pressure in the first control line 112, communicated into the chamber 520 via the first control port 524, in comparison to a lower pressure in the second control line 116, communicated into the chamber 520 via the second control port 526, may force the piston 510 downward, e.g., to the right, as shown. This may force the valve closure element 506 into engagement with the seat 504, thereby closing the valve 500 (preventing fluid communication from the port 514 through the open axial end 512). Similarly, a higher pressure in the second control line 116 relative to the first control line 112 may force the piston 510 upward, e.g., to the left, as shown, raising the valve closure element 506 away from the seat 504, opening the valve 500 and permitting fluid communication between the port 514 and the open axial end 512.

The valve 500 may also include a biasing member 540, such as a spring. In an embodiment, the biasing member 540 may be coiled around the rod 508, as shown. The valve 500 may further include a nut 542, which may be positioned in the housing 502, e.g., threaded into position therein. As such, the nut 542 may be configured to retain its position in the housing 502, despite axial loads from the biasing member 540. The rod 508 may extend through the nut 542 and may be configured to slide relative thereto. The biasing member 540 may also bear against the piston 510, e.g., via a connecting member 544 between the rod and the piston 510.

The biasing member 540 may be configured to apply a biasing force that tends to hold the valve 500 open, e.g., with the valve closure element 506 held away from the seat 504. The nut 542 may be positioned to vary the level of biasing force applied, and it will be appreciated that the biasing force may vary depending on the position of the piston 510. Accordingly, when the pressure differential across the piston 510 generates a sufficient downward force, the biasing force of the biasing member 540 may be overcome, permitting the piston 510 to move downward, and thus forcing the valve closure element 506 into engagement with the seat 504, so as to close the valve 500.

Figure 6:
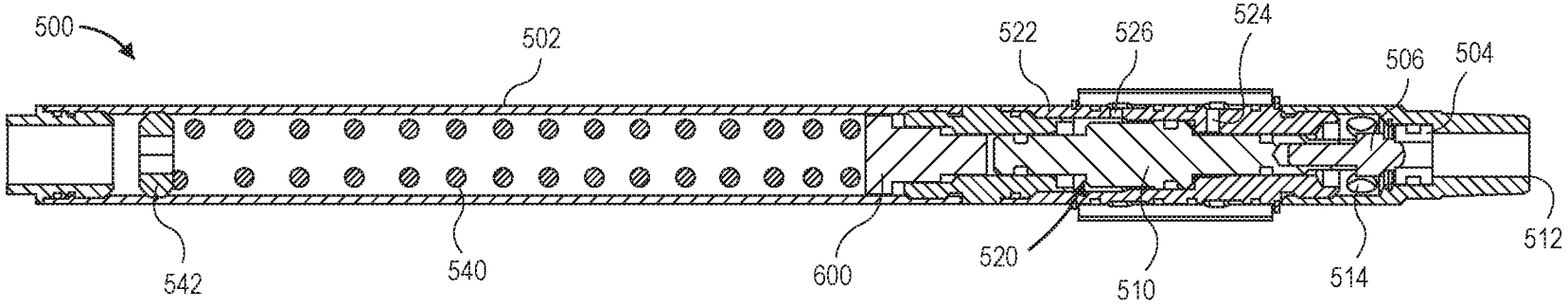
FIG. 6 illustrates a side, cross-sectional view of another embodiment of the valve of the gas lift system.

FIG. 6 illustrates a partial, side, cross-sectional view of another embodiment of the valve 500. In this embodiment, the valve 500 may default to being closed. In the illustrated example, the valve 500 may not include the rod 508. Rather, the piston 510 may be directly connected to the valve closure element 506.

Further, a force-transmission member 600 may engage an opposite side of the piston 510. The biasing member 540 may bear upon the force-transmission member 600 and the nut 542, such that the biasing member 540 is configured to press the force-transmission member 600 downward, to the right, as shown, thereby biasing the valve closure element 506 into engagement with the seat 504. The force-transmission member 600 may also bear against an end of the piston 510. The force-transmission member 600 may be slidable relative to the housing 502. Accordingly, to open the valve 500, the piston 510 is forced upwards by a pressure differential in the chamber 520, e.g., by pressure in the first control line 112 exceeding pressure in the second control line 116 by a predetermined value, such that the pressure differential overcomes the biasing force generated by the biasing member 540.

FIG. 7 illustrates a side, cross-sectional view of the valve 500, according to another embodiment. In this embodiment, the valve 500 has a valve closure element 700 and includes a secondary port 702 that communicates with the production tubing 102. The open axial end 512 may open to the annulus 111, instead of the production tubing 102.

For example, the valve closure element 700 may be or include a piston, which may extend from and move with the piston 510 that is positioned in the chamber 520. As with other embodiments, the piston 510 is moved by a pressure differential between the control lines 112, 116 as communicated into the chamber 522 via the control line ports 524, 526. The valve closure element 700 may slide within the housing 502, such that, in a closed position (as illustrated) the valve closure element 700 blocks fluid flow into the secondary port 702, e.g., from either/both of the open axial end 512 and/or the port 514. Furthermore, the valve closure element 700 may include a pair of seals 704, 706, which, in the closed position, are located on both axial sides of the secondary port 700. In other embodiments, the seals 704, 706 may be positioned on both axial sides of the port 514, or on both axial sides of both ports 514, 700. The seals 704, 706 (or others) may form a seal between the housing 502 and the valve closure element 700, so as to prevent fluid flow into the secondary port 702 when the valve closure element 700 is in the closed position.

The valve 500 of FIG. 7 may default to closed, similar to the valve 500 of FIG. 6, as the biasing force is applied by the biasing member 540 on the force-transmission member 600 presses the valve closure element 700 to the closed position (to the right in this view). It will be appreciated that the valve closure element 700 may be configured to default to the open position, similar to the valve 500 of FIG. 5, by configuring the biasing member 540 to bias the valve closure element 700 toward the open position (to the left in this view) rather than closed.

When the valve closure element 700 is moved to the open position, e.g., by the piston 510 being driven (to the left, as shown) by the pressure differential in the chamber 520, the valve closure element 700 may permit fluid flow from either/both of the open axial end 512 and/or the port 514 to the secondary port 702. For example, the valve closure element 700 may be moved uphole (to the left, in this illustration), such that the seals 704, 706 no longer block fluid flow into the port 702.

Further, because the axial ends 512, 706 of the valve 500 are open to the annulus 111, in this embodiment, the pressure in the annulus 111 may largely be balanced across the piston 510. That is, the pressure in the annulus 111 is applied to the force transmitting member 600, and to the valve closure element 700, and therefore applies little or no net force on the movable elements within the housing 502. Balancing the pressure in the annulus 111 may enable operators to control valve actuation based on the pressure in the control lines 112, 116 and the chamber 520, without having to account for (or at least mitigating the effects of) pressure in the annulus 111.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A gas-lift system, comprising:

a first valve configured to be coupled to a production tubing, wherein the first valve is configured to provide selective communication of a wellbore fluid between an interior of the production tubing an annulus defined exterior to the production tubing;

a second valve configured to be coupled to the production tubing at a position that is subjacent to the first valve, wherein the second valve is configured to provide selective communication of the wellbore fluid between the interior of the production tubing and the annulus; and a first control line and a second control line, the first and second control lines coupled to the first valve and the second valve, wherein the first and second control lines are configured to apply a pressure differential to the first and second valves, the pressure differential being a difference in pressure between pressure in the first and second control lines, wherein the first valve is configured to actuate from an open position to a closed position in response to the pressure differential reaching a first value, and wherein the second valve is configured to actuate from an open position to a closed position in response to the pressure differential reaching a second value that is different from the first value, wherein the first valve comprises:

a chamber;

a piston positioned in the chamber, wherein the first control line communicates with the chamber on a first side of the piston, and wherein the second control line communicates with the chamber on a second side of the piston; and a biasing member configured to resist movement of the piston in at least one direction.

2. The gas-lift system of claim 1, wherein the first control line and the second control line are coupled to the first valve and the second valve in parallel.

3. The gas-lift system of claim 1, wherein the first valve comprises:

a housing defining a first port and a second port, the first port being in communication with the annulus and the second port being in communication with the production tubing; and a valve closure element that is movable with respect to the housing along with the piston, wherein, when the first valve is in the closed position, the valve closure element prevents fluid flow into the production tubing via the first valve, and when the first valve is in the open position, the valve closure element permits fluid flow into the production tubing via the first valve.

4. The gas-lift system of claim 3, wherein the housing further defines first and second open axial ends that communicate with the annulus.

5. The gas-lift system of claim 1, wherein the first valve comprises:

a housing defining a first port and an open axial end, the first port being in communication with the annulus and the open axial end being in communication with the production tubing;

a valve seat positioned in the housing; and a valve closure element that is movable with respect to the housing along with the piston, wherein, when the first valve is in the closed position, the valve closure element engages the valve seat and prevents fluid flow into the production tubing via the first valve, and when the first valve is in the open position, the valve closure element is separated apart from the valve seat and permits fluid flow into the production tubing via the open axial end.

6. The gas-lift system of claim 5, wherein the pressure differential acts across the piston, and wherein the pressure differential reaching the first value is sufficient to overcome a biasing force applied by the biasing member and to move the valve closure element toward or away from the valve seat.

7. The gas-lift system of claim 6, wherein the second valve also includes a biasing member, wherein the biasing member of the second valve applies a different biasing force than the biasing member of the first valve, such that the pressure differential reaching the first value does not cause or permit the second valve to close, and the pressure differential reaching the second value causes or permits the second valve to close.

8. A method for operating a gas-lift system, comprising:

injecting a gas into an annulus between a production tubing and a well, wherein the gas flows from the annulus into the production tubing through a first valve that is open;

closing the first valve by controlling a pressure in a control line that is coupled to the first valve, without causing or permitting a second valve that is subjacent to the first valve to close, wherein the pressure in the control line is independent of a pressure of the gas in the annulus;

increasing the pressure of the gas in the annulus after closing the first valve, such that the gas flows through the second valve and into the production tubing; and closing the second valve by controlling the pressure in the control line, which is also coupled to the second valve, independently of the pressure of the gas in the annulus, while maintaining the first valve in a closed position.

9. The method of claim 8, wherein closing the first valve comprises increasing the pressure in the control line such that a pressure differential generated at least partially by pressure in the control line overcomes a biasing force configured to bias the first valve to an open position.

10. The method of claim 8, wherein closing the first valve comprises reducing the pressure in the control line such that a pressure differential generated at least partially by the pressure in the control line does not overcome a biasing force configured to bias the first valve to a closed position.

11. The method of claim 8, further comprising opening the first and second valves by controlling the pressure in the control line such that a pressure differential generated at least partially by the pressure in the control line causes or permits the first and second valves to open.

12. The method of claim 8, wherein closing the first valve, closing the second valve, or both comprises changing a pressure in a second control line that is coupled to the first valve and the second valve to change a pressure differential in the first and second valves.

13. A gas-lift system, comprising:

a production tubing extending into a wellbore, wherein an annulus is defined radially between the production tubing and the wellbore;

a plurality of gas-lift valves disposed at different depths in the wellbore and configured to selectively communicate the annulus with an interior of the production tubing;

a surface system comprising a pump configured to pump a hydraulic fluid; and a first control line extending from the surface system to the plurality of gas-lift valves, the first control line being configured to deliver the hydraulic fluid from the pump to the plurality of gas-lift valves to control opening and closing of the gas-lift valves independently of a pressure in the annulus and independently of a pressure in the production tubing.

14. The gas-lift system of claim 13, wherein the surface system further comprises a tank configured to contain the hydraulic fluid, the gas-lift system further comprising a second control line extending from the tank to the plurality of gas-lift valves to at least partially balance a pressure supplied to the plurality of gas-lift valves by the first control line.

15. A gas-lift system, comprising:

a production tubing extending into a wellbore, wherein an annulus is defined radially between the production tubing and the wellbore;

a plurality of gas-lift valves disposed at different depths in the wellbore and configured to selectively communicate the annulus with an interior of the production tubing;

a surface system comprising a pump configured to pump a hydraulic fluid; and a first control line extending from the surface system to the plurality of gas-lift valves, the first control line being configured to deliver the hydraulic fluid from the pump to the plurality of gas-lift valves to control opening and closing of the gas-lift valves independently of a pressure in the annulus, wherein the surface system further comprises a tank configured to contain the hydraulic fluid, the gas-lift system further comprising a second control line extending from the tank to the plurality of gas-lift valves to at least partially balance a pressure supplied to the plurality of gas-lift valves by the first control line, and wherein each of the plurality of gas-lift valves comprises:

a pressure chamber in communication with the first and second control lines;

a piston disposed in the pressure chamber and configured to be moved by a pressure differential between the first and second control lines; and a biasing member configured to resist movement of the piston in at least one direction.

16. The gas-lift system of claim 15, wherein each of the plurality of gas-lift valves further comprises:

a primary port in communication with the annulus;

an opening in communication with an interior of the production tubing; and a valve element connected to the piston and configured to be moved therewith between an open position and a closed position, wherein the valve element in the closed position is configured to block communication between the primary port and the opening, and the valve element in the open position is configured to permit communication between the primary port and the opening.

17. The gas-lift system of claim 16, wherein the biasing member is configured to resist movement of the valve element toward the open position, such that the pressure differential across the piston overcomes a biasing force applied by the biasing member so as to open the valve.

18. The gas-lift system of claim 16, wherein the biasing member is configured to resist movement of the valve element toward the closed position, such that the pressure differential across the piston overcomes a biasing force applied by the biasing member so as to close the valve.

* * * * *